US005163208A

United States Patent [19]

Dittly

[11] Patent Number: 5,163,208

[45] Date of Patent: Nov. 17, 1992

[54] SEALING UNIT FOR HEAT TREATMENT APPARATUS FOR TEXTILE THREADS

[75] Inventor: Claude Dittly, Kingersheim, France

[73] Assignee: Passap Knitting Machines Inc., Salt Lake City, Utah

[21] Appl. No.: 691,453

[22] Filed: Apr. 25, 1991

[30] Foreign Application Priority Data

Apr. 27, 1990 [FR] France ..... 90 05611

[51] Int. Cl.[5] ..... D02G 1/18; D06F 81/00; F02F 5/00

[52] U.S. Cl. ..... 28/281; 38/11; 277/138; 277/126; 100/168

[58] Field of Search ..... 28/281; 38/11; 100/168, 100/169, 170; 277/101, 126, 129, 138

[56] References Cited

U.S. PATENT DOCUMENTS

| | | | |
|---|---|---|---|
| 2,453,332 | 11/1948 | Millhiser | 28/281 X |
| 2,782,536 | 2/1937 | Kroener et al. | 38/11 |
| 2,986,912 | 6/1961 | Richeson et al. | 28/281 X |
| 3,040,553 | 6/1962 | Crompton et al. . | |
| 3,298,079 | 1/1967 | Agett et al. | 28/281 X |
| 3,573,875 | 4/1971 | Grodnick et al. . | |
| 3,768,281 | 10/1973 | Sando et al. . | |
| 3,791,055 | 2/1974 | Bazelmaus et al. | 38/11 |
| 3,833,975 | 9/1974 | Cahnman et al. | 28/281 |
| 3,835,490 | 9/1974 | Fleissner | 28/281 X |
| 3,879,868 | 4/1975 | Aerstenberger | 38/11 |
| 4,197,663 | 4/1980 | Riedel | 38/11 X |
| 4,261,586 | 4/1981 | Sando et al. . | |

*Primary Examiner*—Werner H. Schroeder
*Assistant Examiner*—Bibhu Mohanty
*Attorney, Agent, or Firm*—Davis, Bujold & Streck

[57] ABSTRACT

A sealing unit for a heat treatment apparatus for textile threads comprises an upper roller (7) and lower roller (8) between which a conveyor belt (8) passes. The seal between the rollers and the frame (2) of the unit is formed by an upper (29) and lower sealing element (30) with PTFE covers (35) which slide along the rollers, and by two lateral plates (42) contacting the extremities of said covers and of the rollers. Each of said covers is divided into at least two elastically interconnected pieces (35*a*, 35*b*) so that the covering shortens when the lateral plates draw closer to each other due to wear against the roller extremities.

17 Claims, 5 Drawing Sheets

SEALING UNIT FOR HEAT TREATMENT APPARATUS FOR TEXTILE THREADS

The present invention generally concerns a sealing element designed to cooperate in sliding contact with a cylindrical rotating roller. More specifically, it concerns a sealing unit for an inlet or outlet of a pressure apparatus for heat treatment of textile threads deposited on a conveyor belt traversing said unit, said sealing unit comprising:

a) a frame attached to said pressure apparatus;

b) a pair of superimposed horizontal rollers pressing against opposite surfaces of the conveyor belt with clamping means, at least one of said rollers being attached to the frame so that it can move toward the other roller, the respective extremities of said rollers being vertically aligned.

c) sealing means forming a tight seal between the rollers and the frame, said means comprising an upper element and a lower element which are elongate and in respective contact with the generatrices of the two rollers, and each of which has a surface with a sealing cover of anti-friction material which slides along the corresponding roller, said sealing means further comprising two lateral plates, each of which is in sliding contact with the corresponding extremities of the two rollers and of the sealing covers on the said upper and lower elements.

In such a sealing unit the surfaces of the sealing means which are in contact with the rollers are progressively worn out by the rubbing of the rollers and so need periodic replacement. If the sealing covers on the upper and lower elements are worn to a certain depth, this does not pose a major problem, as each of these elements can easily draw close to the corresponding roller. However, each lateral plate has a surface with one zone contacting the extremities of the two rollers and with two other zones in respective contact with the extremities of the sealing covers on the upper and lower elements. The zone in contact with the rollers tends to wear out, but not the others. The result of this is undesirable differences in contact pressure. Moreover, this phenomena tends to compress said sealing covers longitudinally, which ultimately shortens them. Then when the worn lateral plates are replaced, the covers do not regain their original length and a certain amount of play persists, causing leaks between their extremities and the lateral plates.

The aim of the present invention is to perfect the sealing means of such a unit so as to ensure that sealing is as constant as possible, not only during progressive wear on the contact surfaces, but also after replacement of the worn lateral plates.

To achieve this, the invention concerns a sealing element and a sealing unit as defined in the preamble, wherein each of said sealing covers comprises two pieces separated by at least one connection and each having one extremity applied to one of the lateral plates, said pieces being connected to elastic means which allow the sealing cover to shorten when compressed between the lateral plates.

Preferably, the said upper element is situated above the upper roller and the said lower element is disposed beneath the lower roller.

The sealing covers are preferably made of polytetrafluoroethylene which may or may not be saturated with graphite, carbon or another component.

Said connection may be shaped so that at least one portion is oblique in relation to the longitudinal direction of said upper or lower element, that is, V-shaped.

In another embodiment, said connection may be shaped so that at least one portion is parallel to the longitudinal direction of the upper or lower element, the two pieces being in mutual contact along this portion of the connection.

In another embodiment, each one of the sealing covers is composed of a row of pieces separated by transverse connections.

Said elastic means preferably comprises a profiled elastic rubber element to which said covering pieces are attached.

Said upper or lower element may comprise a profiled metal element with a longitudinal groove in which said profiled rubber element is inserted.

Another feature of the present invention concerns a sealing element designed to cooperate in sliding contact with a cylindrical rotating roller and with a pair of lateral sealing plates which contact the respective extremities of the sealing element and of the roller, the sealing element having an elongate sealing cover made of anti-friction material which contacts the peripheral surface of the roller along a generatrix of said surface, wherein said sealing cover comprises two pieces separated by at least one connection, each having one extremity applied to one of said lateral plates, said pieces being connected to flexible means allowing the sealing cover to become shorter when compressed between said lateral plates.

There is described below, by way of non-limiting example, one embodiment of the invention with reference to the attached drawings, wherein.

Figure 1:
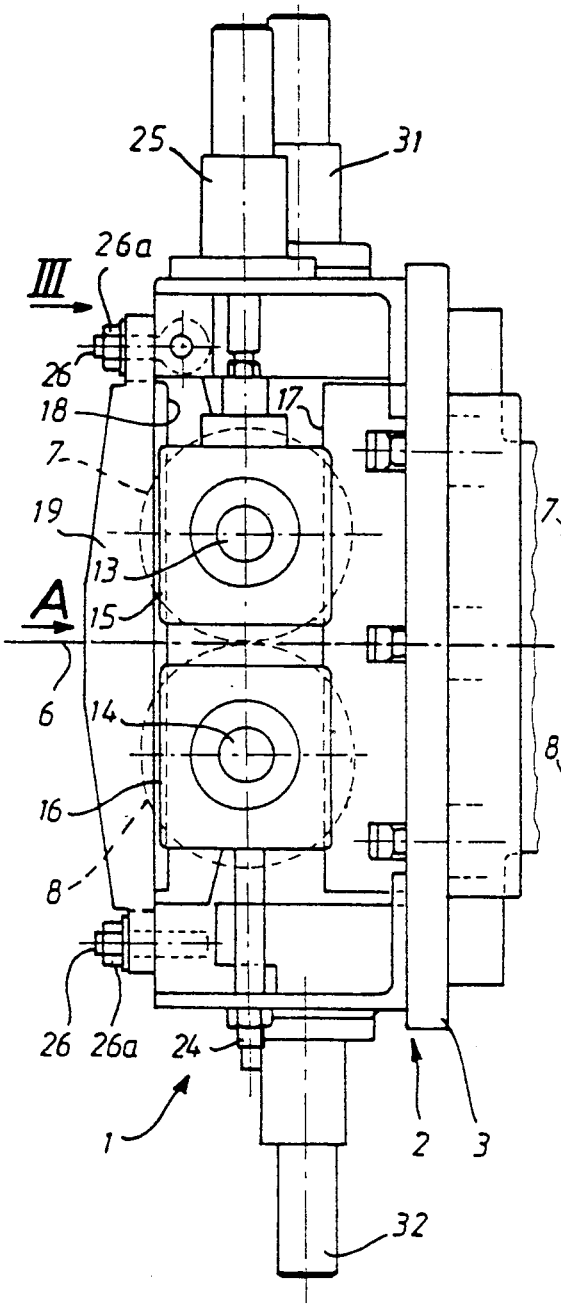
FIG. 1 is a lateral elevation of one embodiment of a sealing unit according to the invention.

In the embodiment shown in FIGS. 1 through 6, a sealing unit 1 according to the invention comprises a rigid frame 2 with a vertical base plate 3 tightly attached to a flange 4 which, in the present case, surrounds an inlet opening 5 of a heat treatment apparatus for textile thread using pressurized steam. The threads to be treated, usually in the form of spirals, are continuously deposited on a perforated metal conveyor belt 6 circulating in the direction of arrow A and successively passing through the sealing unit 1, inlet opening 5 of the apparatus, the apparatus itself, then an outlet opening having a sealing unit similar to unit 1. Belt 6 and the threads it carries pass freely through inlet opening 5, which is impermeably sealed from the outside of the apparatus by sealing unit 1. The latter comprises, in known manner, an upper roller 7 and a lower roller 8 situated one above the other, on one side and the other of belt 6, and which roll without sliding on the belt or on the threads it carries. Each roller 7, 8 comprises a thick envelope 9, 10 of compressible material such as rubber, and a rigid tube 11, 12 with end spindles 13, 14 rotatably supported by bearing cases 15, 16 attached to vertical lateral guides 17, 18 on frame 2. Lower roller 8 is caused to rotate at a speed corresponding to the advancement speed of belt 6 by means of a mechanism partially visible in FIG. 3. Spindle 14 of lower roller 8 has a toothed gear 20 with a chain, driven by a motor, and a pinion 21 meshing with a pinion 22 of the same diameter attached to spindle 13 of the upper roller. Upper roller 7 is caused to rotate by friction, while pinions 21 and 22 simply ensure synchronization of the speed of the two rollers.

For determining the level of lower roller 8 a bolt 24 engaged in a threaded bore of frame 2 acts as a regulable vertical block for bearing 16 at each roller extremity. As for upper roller 7, it presses against belt 6 in the direction of the lower roller by means of a pair of mechanical, pneumatic or preferably hydraulic cylinders 25 acting vertically on bearings 15.

Each of the two guides 18 situated on the frontal side of the unit, that is, on the side opposite the apparatus, is held by a vertical bracket 19 removably attached to the frame, for example by means of bolts 26 and screws 26*a*. Because of this construction, removal of brackets 19 allows each roller 7, 8 to be removed directly with its bearing cases 15, 16.

Opposite each roller 7, 8 frame 2 has a fixed horizontal element 27, 28 forming a sort of raised edge in the direction of the corresponding roller. Sealing between rollers 7, 8 and these fixed elements 27, 28 is achieved by means of an upper sealing element 29 and a lower sealing element 30, each of which is maintained in contact with the roller and the corresponding fixed element by virtue of a row of vertically acting mechanical, pneumatic or hydraulic cylinders 31, 32.

Figure 2:
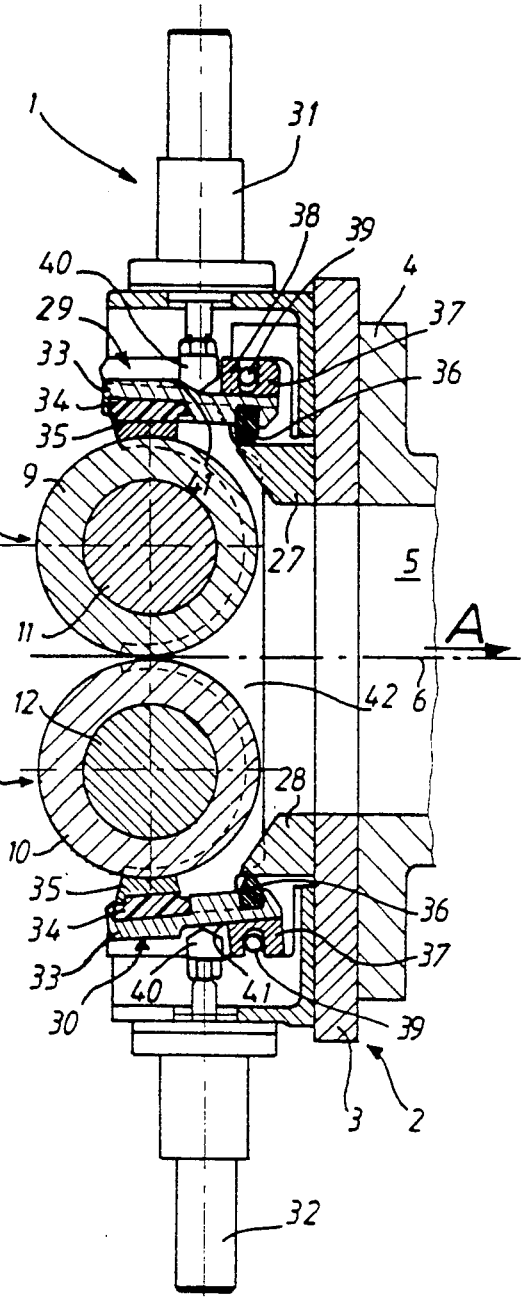
FIG. 2 is a vertical cross-section of said unit taken along line II—II of FIG. 3.
Figure 3:
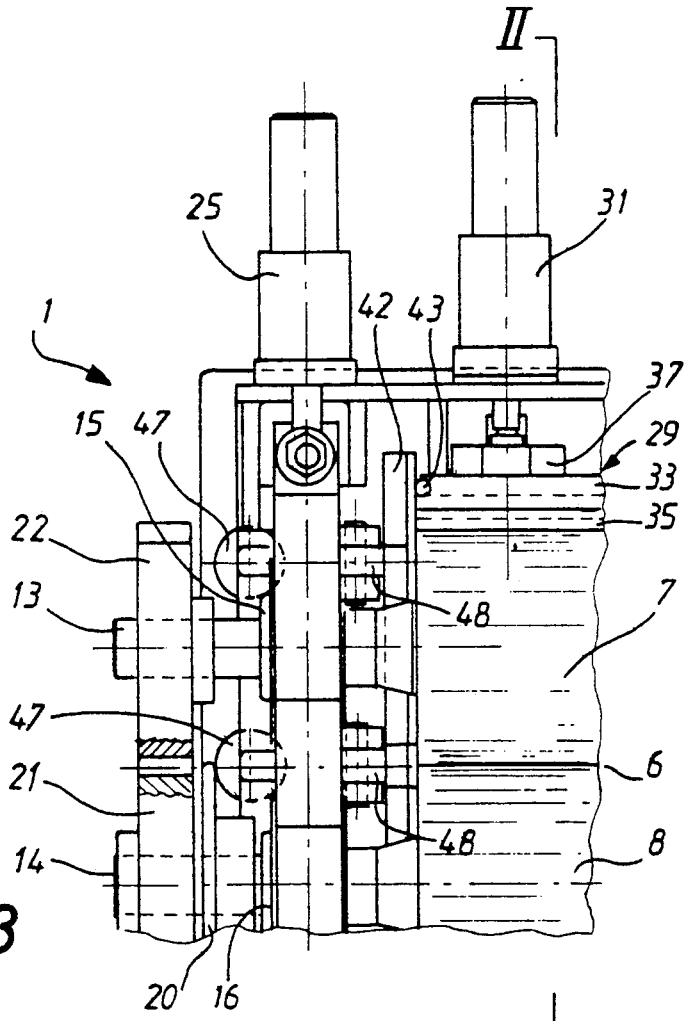
FIG. 3 is a partial frontal view along arrow III of FIG. 1.

As is more particularly shown in FIG. 2, each sealing element 29, 30 comprises a metal base plate 33 approximately horizontally disposed and extending along the entire length of the corresponding roller. Across from rollers 7, 8 this plate has a first groove to which a slippery covering in the form of a profiled strip is attached, comprising a flexible profiled element 34 of compressible material, for example foam rubber, and a superficial covering 35 made of material with a low coefficient of friction, for example, polytetrafluoroethylene saturated with carbon or molybdenum. This covering is flat or slightly curved and is applied in a vertical direction to the corresponding roller 7, 8, that is, along a generatrix diametrically opposed to the line of contact between the rollers and the conveyor belt 6. Each base plate 33 also has a second groove located on the same side and parallel to the first, onto which a profiled element 36 made of synthetic material is attached, in vertical contact with a horizontal surface of corresponding fixed element 27, 28. On the side opposite this profiled element, base plate 33 is provided with at least two guide blocks 37 with a vertical notch 38 engaging a small cylindrical bar 39 attached to the frame. In this way, each sealing element 29, 30 is correctly guided and cannot be displaced by roller rotation, but benefits from a certain amount of play in the vertical direction and in the direction of the length of the roller.

Figure 7:
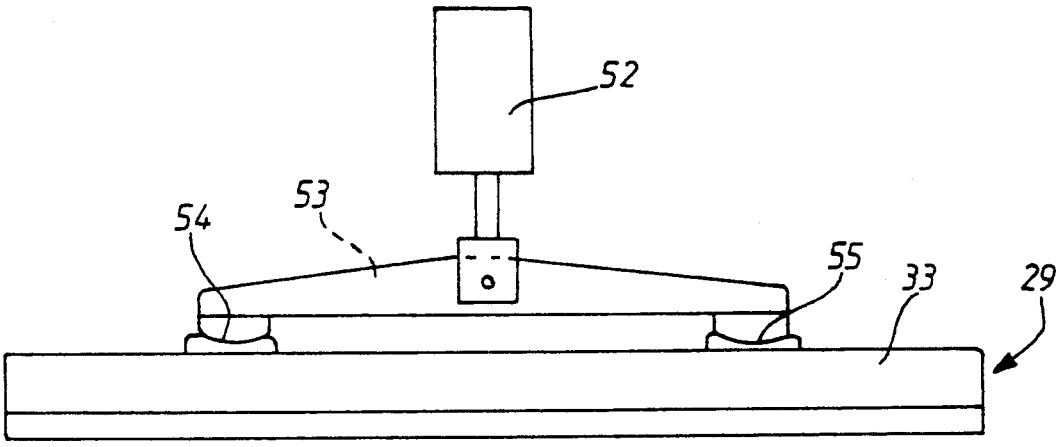
FIG. 7 is a schematic frontal view showing a variation with a hydraulic cylinder contact means.

In this example, each sealing element 29, 30 is vertically pushed by parallel cylinders 31, 32 each with a convex head 40 contacting a corresponding bushing 41 attached to base plate 33. All the cylinders in a row are hydraulically interconnected so as to exert equal forces along the sealing device. In another embodiment, shown schematically in FIG. 7, each row of cylinders 31, 32 is replaced by a central cylinder 52 attacking a mechanism articulated to a balance 53 with two equal arms, exerting equal vertical forces on base plate 33 at two spaced apart points 54 and 55. In another instance, mechanical or pneumatic cylinders could be substituted for hydraulic cylinders 31, 32 or 52.

In the construction described above, it should be noted that the contact forces exerted by cylinders 31, 32 or 52 on corresponding sealing element 29, 30 are exerted on a vertical plane passing between connection 36 and sealing cover 35, thereby automatically maintaining sealing contact between sealing element 29, 30 on the one hand, roller 7, 8 and fixed element 27, 28 on the other hand. The cylinders are preferably two-way cylinders so that the head 40 may be easily retracted to extract corresponding sealing element 29, 30 by pivoting it around bars 39, then removing it from the sealing unit without dismantling any other pieces. Thus, periodic control and maintenance of the sealing covers, the roller and the other elements of the sealing unit are considerably facilitated.

Figure 8:
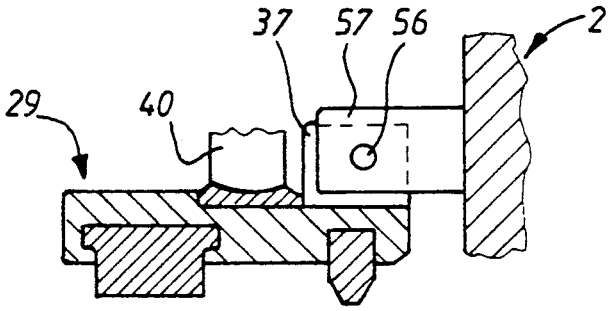
FIG. 8 shows a variation in the attachment of the sealing means appearing in FIG. 2.

FIG. 8 is a schematic representation of a variation in the attachment of upper sealing element 29 to be attached to frame 2. In this case, instead of being attached to frame 2. In this case, instead of being slidably attached, guide block 37 is provided with a horizontal opening into which there is inserted a peg 56 also passing through corresponding openings in two fixed brackets 57 located on one side and the other of block 37. Element 29 can support several blocks 37 spaced along it; it can be easily removed the sealing unit after removal of pegs 56.

The advantages of the disposition of sealing means 29 and 30 as described above appear clearly in FIG. 2. As these devices are respectively above and beneath corresponding rollers 7, 8 each is situated opposite a frontal opening through which it can be removed from sealing unit 1 in the direction opposite arrow A. The presence of these frontal openings also facilitates monitoring the cleanliness and wear of the sealing covers, which can be cleaned by raising them slightly.

Sealing between frame 2 and the surfaces of the extremities of rollers 7, 8 is ensured by two lateral sealing plates 42 which extends between the extremities of the upper sealing elements 29 and lower sealing elements 30 and which abut the extremities of covers 35 and a compressible connection 43 (FIG. 3) attached along each extremity of base plates 33.

Figure 5:
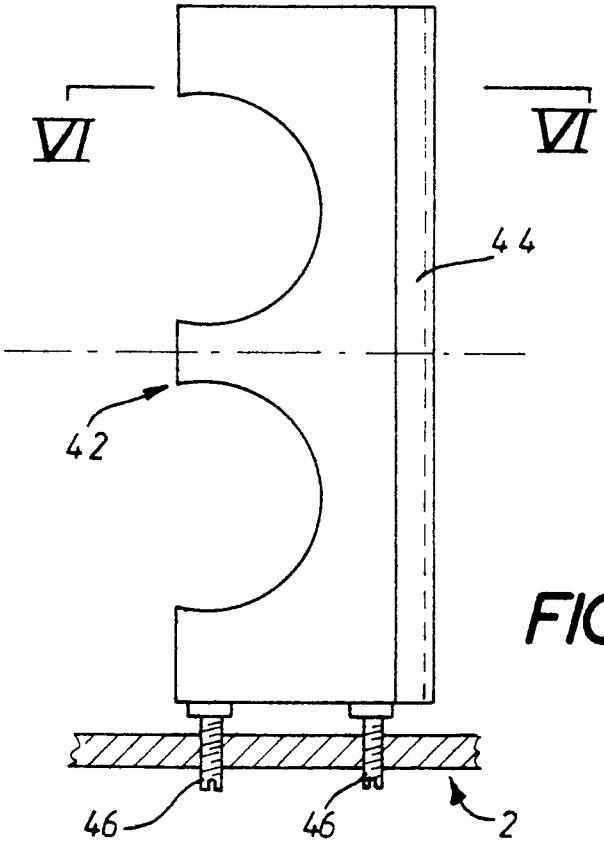
FIG. 5 is a schematic elevation of a lateral sealing plate in a plane parallel to those of FIGS. 1 and 2.
Figure 6:
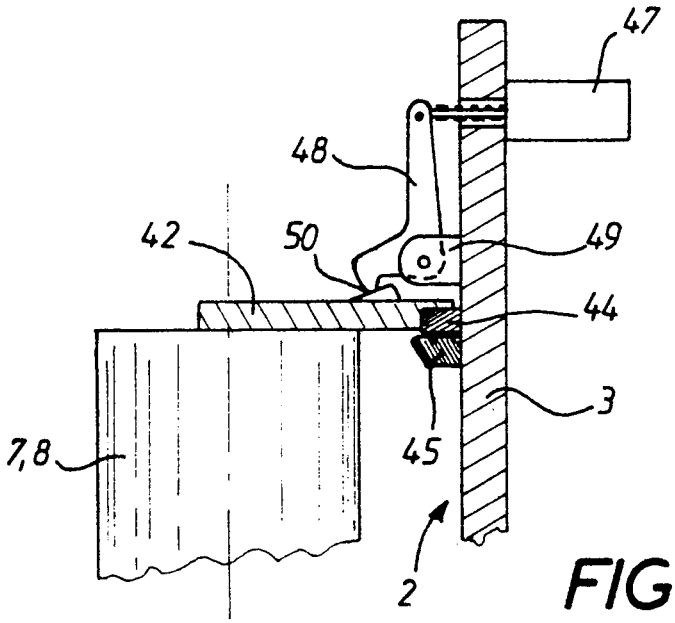
FIG. 6 is a horizontal cross-section taken along line VI—VI of FIG. 5.

FIGS. 5 and 6 show schematically one of the lateral plates 42 which may consist, for example, of a plate of rigid synthetic mateial or a metal plate covered with polytetrafluoroethylene so the extremities of rollers 7, 8 slide easily along it. On the side of base plate 3 of the frame, plate 42 has a rectilinear rim to which is attached a flexible connection 44 in continuous contact along a fixed element 45 which connects elements 27 and 28 (FIG. 2) of the frame. Plate 42 rests on two bolts 46 attached to frame 2 for adjusting its level. In addition, plate 42 is flexibly pushed in the horizontal direction against fixed element 45 and against the extremities of rollers 7 and 8 by a mechanism comprising in this example, three horizontal pneumatic or hydraulic cylinders 47 which push the plate by means of respective angle connecting rods 48 pivotably mounted on support 49 attached to the frame. Each connecting rod 48 abuts an oblique surface 50 disposed on plate 42, thereby maintaining the plate in position by contacting its connection 44 with two perpendicular surfaces on element 45 and on plate 3 of the frame. Because of this arrangement, lateral plates 42 may be easily dismantled by activating two-way cylinders 47 to free them.

Figure 4:
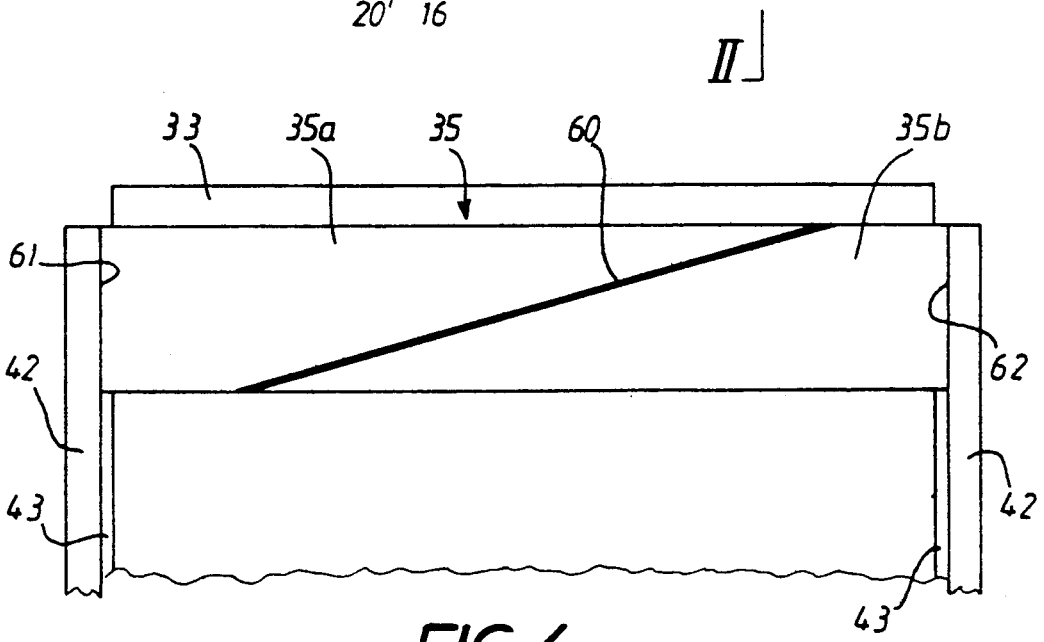
FIG. 4 shows one embodiment of a sealing element of said unit.

FIG. 4 shows an embodiment of the sealing cover 35 of upper element 29 or of lower element 30. Of course, this concerns the surface of the covering designed for contact with corresponding roller 7, 8. Covering 35 is a PTFE plate divided into two pieces 35*a* and 35*b* along an oblique connection or gap 60 which extends along the major portion of the length of covering 35. This connection is not very wide, for example, of the order of 1 millimeter. It may be hollow or filled with highly compressible material. When extremities 61 and 62 of covering 35 are pressed by lateral plates 42, the two pieces 35*a* and 35*b* can move slightly toward each other in the longitudinal direction because of the elasticity of the rubber profiled element 34 (FIG. 2) to which they are attached, thereby moving the edges of connection 60 toward each other to a very slight extent. This movement may continue gradually as lateral plates 42 become worn from contact with the roller extremities. If the two edges of the connection touch each other, they can still slide against each other to allow further shortening of covering 35.

Figure 9:
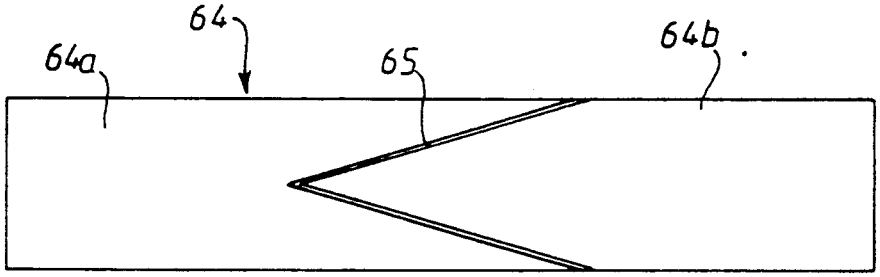
FIGS. 9 through 11 are analogous to FIG. 4 and show other embodiments of a sealing element.
Figure 10:
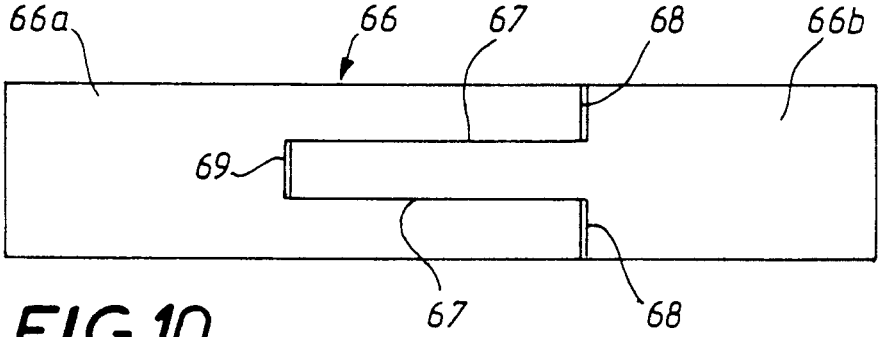
Figure 11:
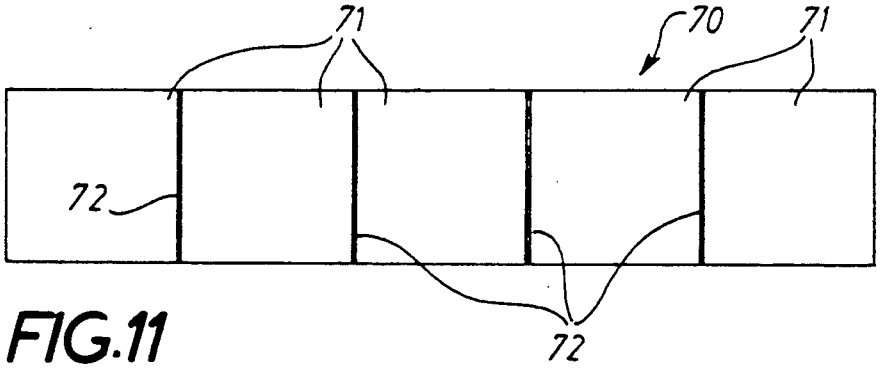

FIGS. 9 through 11 show other embodiments which may be used instead of those in FIG. 4. In the case of FIG. 9, a sealing cover 64, having the same role as cover 35, is composed of two pieces 64*a* and 64*b* separated by a V-shaped connection 65 functioning in essentially the same way as connection 60.

In the case of FIG. 10 a sealing cover 66 is composed of two pieces 66*a* and 66*b* separated by a step-like connection. This connection comprises two longitudinal portions 67 where the connection is closed, that is, the two pieces are always in contact along two portions of the connection and of the transverse portions 68 and 69 which may be slightly open or filled with a highly compressible material. Longitudinal elasticity of covering 66 may be ensured by a profiled rubber element similar to profiled element 34 described above. In other embodiments the profiled element may bre eliminated and replaced by springs tending to separate the two relatively rigid pieces 66*a* and 66*b* longitudinally.

FIG. 11 shows yet another embodiment wherein a covering 70 attached to a profiled rubber element such as 34 is composed of a row of plates 71 separated by transverse connections 72 which may be very narrow. Depending upon the case, connections 72 may also be oblique or zigzagged.

The present invention is not limited to the exemplary embodiments described above, but extends to any modification or variation obvious to one skilled in the art. It applies not only to sealing means for the inlets or outlets of textile thread treatment apparatus, but more generally to similar sealing devices between a rotating roller and a stationary element such as a frame, with either a fixed or an oscillating roller.

Claims:

1. A sealing unit for an inlet or outlet of a pressure apparatus for heat treatment of textile threads deposited on a conveyor belt passing through said unit, said sealing unit comprising:

a) frame (2) attached to said pressure apparatus;

b) a pair of superimposed vertical rollers (7,8) pressing against opposite surfaces of the conveyor belt (6) by clamping means, at least one of said rollers being attached to the frame (2) so that it can move toward the other roller, the respective extremities of said rollers being verticall aligned;

c) sealing means forming a tight seal between the rollers (7,8) and the frame (2), said sealing means comprising an upper element (29) and a lower element (30) which are elongate and in contact with an exterior surface of the upper and lower rollers, respectively, and each of said elements having a sealing cover (35) of anti-friction material with a surface which slides along the respective roller, said sealing means further comprising two lateral plates (42), each of which is in sliding contact with the corresponding extremities of the two rollers and the sealing covers of the said upper and lower elements, wherein each of said sealing covers comprises two pieces (35*a*, 35*b*) spaced apart by at least one gap (60) and each piece having one extremity in contact with one of said lateral plates, said pieces being connected to the respective upper and lower elements by elastic means allowing the sealing cover to shorten when compressed between said lateral plates.

2. A sealing unit according to claim 1, wherein said upper element (29) is disposed above the upper roller (7) and said lower element (30) is disposed beneath the lower roller (8).

3. A sealing unit according to claim 1, wherein said sealing covers are polytetrafluoroethylene.

4. A sealing element according to claim 1, wherein each of said sealing elements comprising two pieces (35*a*, 35*b*) spaced apart by at least one gap (60), and said gap has at least one portion which is oblique in relation to a longitudinal direction of said upper and lower elements.

5. A sealing unit according to claim 4, wherein said gap is V-shaped.

6. A sealing unit according to claim 1, wherein said gap has at least one portion extending parallel to the upper element (29) and lower element (30) and at least one portion extending perpendicular to the upper element (29) and the lower element (30), and the two pieces (35*a*, 35*b*) are in contact along said parallel portion.

7. A sealing unit according to claim 1, wherein each of the sealing covers is composed of a row of pieces spaced by transverse connections.

8. A sealing means according to claim 1, wherein said elastic means comprises a flexible rubber profiled element (34) to which said sealing covers are attached.

9. A sealing means according to claim 8, wherein at least one of said upper and lower elements comprises a metal profiled element (33) provided with a longitudinal groove into which said rubber profile element is inserted.

10. A sealing element of a sealing unit for an inlet or outlet of a pressurized apparatus for heat treatment of textile threads deposited on a conveyor belt passing through said apparatus, said sealing unit comprising:

a) a frame (2) attached to said pressurized apparatus;

b) a pair of superimposed vertical rollers (7, 8) which are pressed against opposite surfaces of the conveyor belt (6) by clamping means, at least one of the rollers being attached to said frame so that it can move toward the other roller, said rollers having respective extremities which are vertically aligned;

c) sealing means to form a tight seal between the rollers and the frame, said means comprising an upper element (29) and a lower element (30) which are elongate and in contact with an exterior surface of the upper and lower rollers, respectively, and each of said elements having a sealing cover (35) of anti-friction material with a surface which slides along the respective roller, said sealing means further comprising two lateral plates (42), each one of which is sliding contact with corresponding extremities of the two rollers and the sealing covers of said upper and lower elements.

11. A sealing element according to claim 10, in which each of said sealing covers is made of polytetrafluoroethylene.

12. A sealing element according to claim 10, in which each of said sealing elements comprising two pieces (35*a*, 35*b*) spaced apart by at least one gap (60), and said gap has at least one portion which is oblique in relation to a longitudinal direction of said upper and lower elements.

13. A sealing element according to claim 12, in which said gap is V-shaped.

14. A sealing element according to claim 10, in which each of said sealing elements comprising two pieces (35*a*, 35*b*) spaced apart by at least one gap (60), and said gap has at least one portion extending parallel to the upper and lower elements, and the two pieces (35*a*, 35*b*) are in contact along the parallel portion.

15. A sealing element according to claim 10, in which the sealing cover comprises a row of pieces separated by transverse joints.

16. A sealing element according to claim 10, in which said elastic means comprises a profiled element of elastic rubber (34) to which said sealing covers are attached.

17. A sealing element according to claim 16, comprising a profiled metal element (33) with a longitudinal groove into which said profiled rubber element is inserted.

* * * * *